US006352009B1

(12) United States Patent
Gaidjiergis

(10) Patent No.: US 6,352,009 B1
(45) Date of Patent: Mar. 5, 2002

(54) TOOL AND METHOD FOR INSTALLING AND/OR REMOVING FASTENERS

(75) Inventor: Timothy J. Gaidjiergis, Renton, WA (US)

(73) Assignee: Shear Technologies, LLC, Kingston, WA (US)

( * ) Notice: Subject to any disclaimer, the term of this patent is extended or adjusted under 35 U.S.C. 154(b) by 0 days.

(21) Appl. No.: 09/594,742

(22) Filed: Jun. 13, 2000

(51) Int. Cl.[7] ..... B25C 3/00
(52) U.S. Cl. ..... 81/44; 254/25; 7/169
(58) Field of Search ..... 81/44, 45; 254/25; 7/169

(56) References Cited

U.S. PATENT DOCUMENTS

| | | | | | |
|---|---|---|---|---|---|
| 590,760 | A | * | 9/1897 | Heath | 7/169 |
| 768,009 | A | * | 8/1904 | Boulter | 81/45 |
| 1,029,578 | A | * | 6/1912 | Ferrall et al. | 29/267 |
| 1,280,549 | A | * | 10/1918 | Reynolds | 7/147 |
| 1,435,885 | A | * | 11/1922 | Wisroth | 7/158 |
| 3,813,081 | A | * | 5/1974 | Alger | 254/131 |

OTHER PUBLICATIONS

Carpet Installation Tools, *Drive Down Bar*, #867 Drive Down Bar—$51.98 <http://www.tools4floors.com/page9.htm> (Apr. 17, 2000).
Fladgard, Scott C., "*Declaration of Scott C. Fladgard*," Jul. 8, 2001, (2 pages and shipping invoice attached).

* cited by examiner

*Primary Examiner*—Joseph J. Hail, III
*Assistant Examiner*—David B. Thomas
(74) *Attorney, Agent, or Firm*—Perkins Coie LLP

(57) ABSTRACT

A tool and method for installing and/or removing fasteners in areas where access is limited. In one embodiment, the tool has a fastener engagement portion toward a first end, a fastener removal portion toward a second end, and an impact surface positioned between the fastener engagement and fastener removal portions. The fastener engagement portion is configured to releasably engage a fastener, and is offset from the impact surface to facilitate positioning a fastener in a confirmed space. The impact surface is configured to remain accessible once the fastener has been properly positioned for installation. A user can strike the impact surface to drive the fastener into a workpiece. The fastener removal portion is configured to engage an installed fastener to extract the installed fastener from the workpiece.

34 Claims, 6 Drawing Sheets

TOOL AND METHOD FOR INSTALLING AND/OR REMOVING FASTENERS

TECHNICAL FIELD

The present invention relates to a hand-held tool for installing and/or removing a fastener, and more particularly, to a hand-held tool for installing and/or removing a fastener when access to the fastener is limited, for example, when replacing a roofing shingle that may be positioned underneath another shingle.

BACKGROUND

The roofs of houses and other buildings are commonly covered with various types of overlapping shingles to protect the underlying structure from direct exposure to the elements. These shingles are installed in rows, starting at the lower edge of the roof and moving upward. Accordingly, each succeeding row of shingles partially overlaps the prior row and completely covers the fasteners that attach the prior row to the roof substructure.

Conventional roofing shingle materials include wood, slate, metal, tile, fiberglass and asphalt. Asphalt shingles represent the most widely used form of residential roofing and cover four out of every five homes in the United States today. Asphalt shingles are typically made from an organic or fiberglass base that is saturated with an asphalt coating and surfaced with weather resistant mineral granules. Accordingly, asphalt shingles are typically durable, versatile and economical. Furthermore, asphalt shingles are generally pliant when new, making them easy to install. Over time, however, the effects of aging and exposure to the sun harden asphalt shingles to the point that even modest flexing can cause the shingles to break or permanently deform.

Asphalt shingle roofs can last up to 20 years before replacement, and damage to individual shingles during this time (for example, due to high winds or human traffic) is not uncommon. A widespread problem faced by roofing contractors is to replace an individual damaged shingle without damaging the overlapping undamaged shingle in the process.

One conventional method for replacing shingles includes sliding a flat-bladed shovel-like device under the damaged shingle to pry loose the fasteners attaching the damaged shingle to the roof substructure. Unlike a conventional claw hammer, the flat-bladed device can access the fasteners without bending the overlapping undamaged shingle to the point that the undamaged shingle breaks.

Once the fasteners have been removed, the damaged shingle may be slipped out from under the overlapping undamaged shingle and a replacement shingle slipped in underneath the overlapping shingle. At this point, the contractor must generally use to a conventional hammer to install the fasteners in the replacement shingle. Because it is desirable to cover the installed fasteners with the overlapping undamaged shingle, installation requires positioning the fastener on the replacement shingle while simultaneously bending the overlapping undamaged shingle far enough back to allow the contractor to strike the fastener with the hammer. Bending the undamaged shingle in this manner often breaks the undamaged shingle, forcing the user to repeat the entire process for two damaged shingles instead of just one.

SUMMARY OF THE INVENTION

The present invention is directed to methods and apparatuses for installing and/or removing fasteners. In one aspect of the invention, the apparatus can include a tool body with a fastener engagement portion toward a first end, a fastener removal portion toward a second end, and an impact surface located between the two ends. The fastener engagement portion can be offset from the impact surface in two directions and can have at least one fastener contact surface that is offset from and at least approximately parallel to the impact surface. The fastener engagement portion can be configured to releasably engage a fastener to install the fastener in a workpiece when a force is applied to the impact surface of the body. The fastener removal portion can also be offset from the impact surface in two directions, and can be configured to releasably engage an installed fastener to remove the fastener from a workpiece when a force is applied to the body.

In one aspect of the invention, the fastener engagement portion can further include first and second fastener guide surfaces. The first and second guide surfaces can be in a common plane and can be spaced apart from the fastener contact surface by a first gap distance sized to removably receive the head of a fastener. The first and second fastener guide surfaces also being spaced apart from each other by a second gap distance sized to removably receive the shank of the fastener. In a further aspect of the invention, the fastener removal portion can have first and second fingers extending away from the impact surface. The first finger of the fastener removal portion can include a first interior edge and the second finger can further include a second interior edge. The first and second interior edges can be in a common plane and can define a tapering gap that is sized to removably receive the shank of an installed fastener. In a still further aspect of the invention, the fastener removal portion toward the second end can be replaced with a scraper portion, a G-shaped pry-hook portion, or another fastener engagement portion, or the fastener removal portion can be eliminated.

In another aspect of the invention, a method for removing a fastener from a workpiece can include engaging a fastener between a first and second finger of an offset fastener removal portion of a fastener handling tool and applying a force to the tool body to remove the fastener from the workpiece. In a further aspect of the invention, the method can include engaging a fastener with an offset fastener engagement portion of a fastener handling tool inserting the offset fastener engagement portion into a confirmed space, positioning the engaged fastener on the workpiece, exposing an impact surface of the tool, and impacting the impact surface to drive the fastener into the workpiece.

DETAILED DESCRIPTION

An apparatus and method for installing and/or removing fasteners is described herein. One embodiment of the invention includes a tool and method for installing fasteners in a replacement roofing shingle without damaging the previously installed overlapping shingle. Many specific details of certain embodiments of the invention are set forth in the following description and in FIGS. 1–9 to provide a thorough understanding of such embodiments. One of ordinary skill in the art, however, will understand that the present invention may have additional embodiments, or that the invention may be practiced without several of the details described in the following description.

Figure 1:
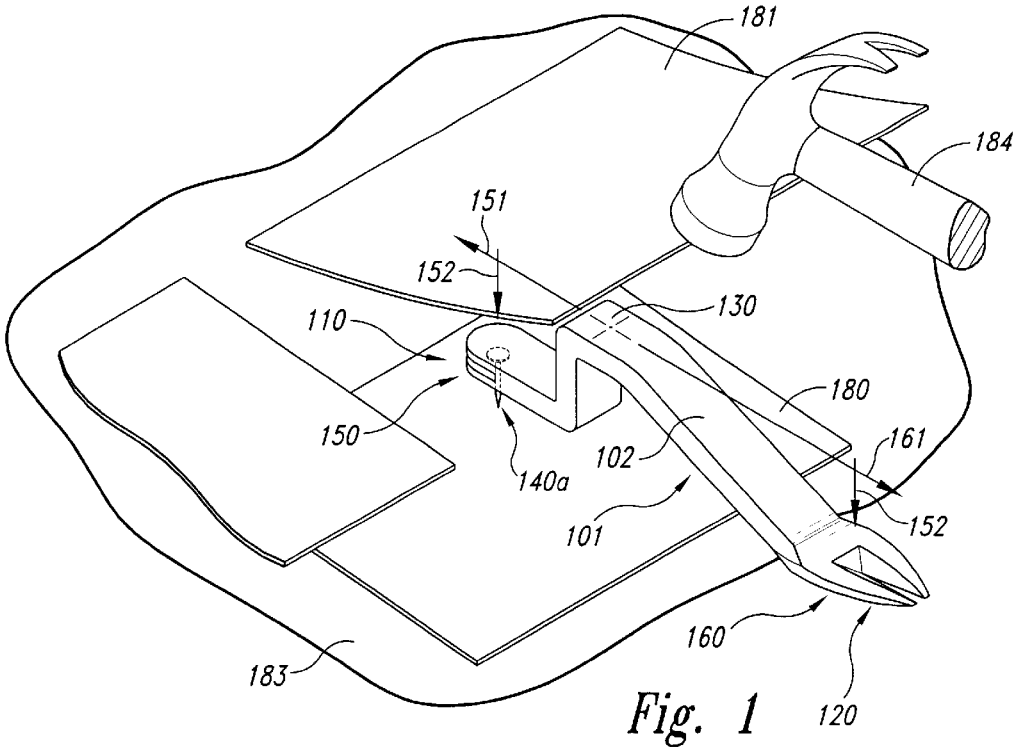
FIG. 1 is a rear isometric view of a fastener installation and removal tool positioned to install a fastener in a replacement roofing shingle that is located underneath an installed shingle in accordance with an embodiment of the invention.

FIG. 1 is a rear isometric view of a hand-held fastener installation and removal tool 101 positioned to install a new fastener 140*a* in a workpiece, such as a replacement shingle 180, without damaging a previously installed shingle 181. The tool 101 can also be used to remove fasteners and damaged shingles from beneath the previously installed shingle 181 without damaging the previously installed shingle 181. Accordingly, in one embodiment, the installation and removal tool 101 has a fastener engagement portion 110 toward a first end 150, and a fastener removal portion 120 toward a second end 160. An impact surface 130 is located between the fastener engagement portion 110 and the fastener removal portion 120. As shown in FIG. 1, the fastener engagement portion 110 is offset from the impact surface 130 in a first direction 151 and in a second direction 152 transverse to the first direction 151. Similarly, the fastener removal portion 120 is offset from the impact surface 130 in the second direction 152 and in a third direction 161 transverse to the second direction 152. The impact surface 130 of the tool 101 is shaped to be struck with a conventional hammer 184 or other tool to provide the impact required to drive the fastener 140*a* through the replacement shingle 180 and into a roof substructure 183. In one embodiment, the tool 101 can include a handle portion 102 between the impact surface 130 and the second end 160 for grasping and maneuvering the tool 101.

In one embodiment, the tool 101 may be cast in steel and finish machined. In other embodiments, the tool 101 may be forged or machined from steel. In still further embodiments, the tool 101 can include materials other than steel having suitable strength and stiffness.

Figure 2:
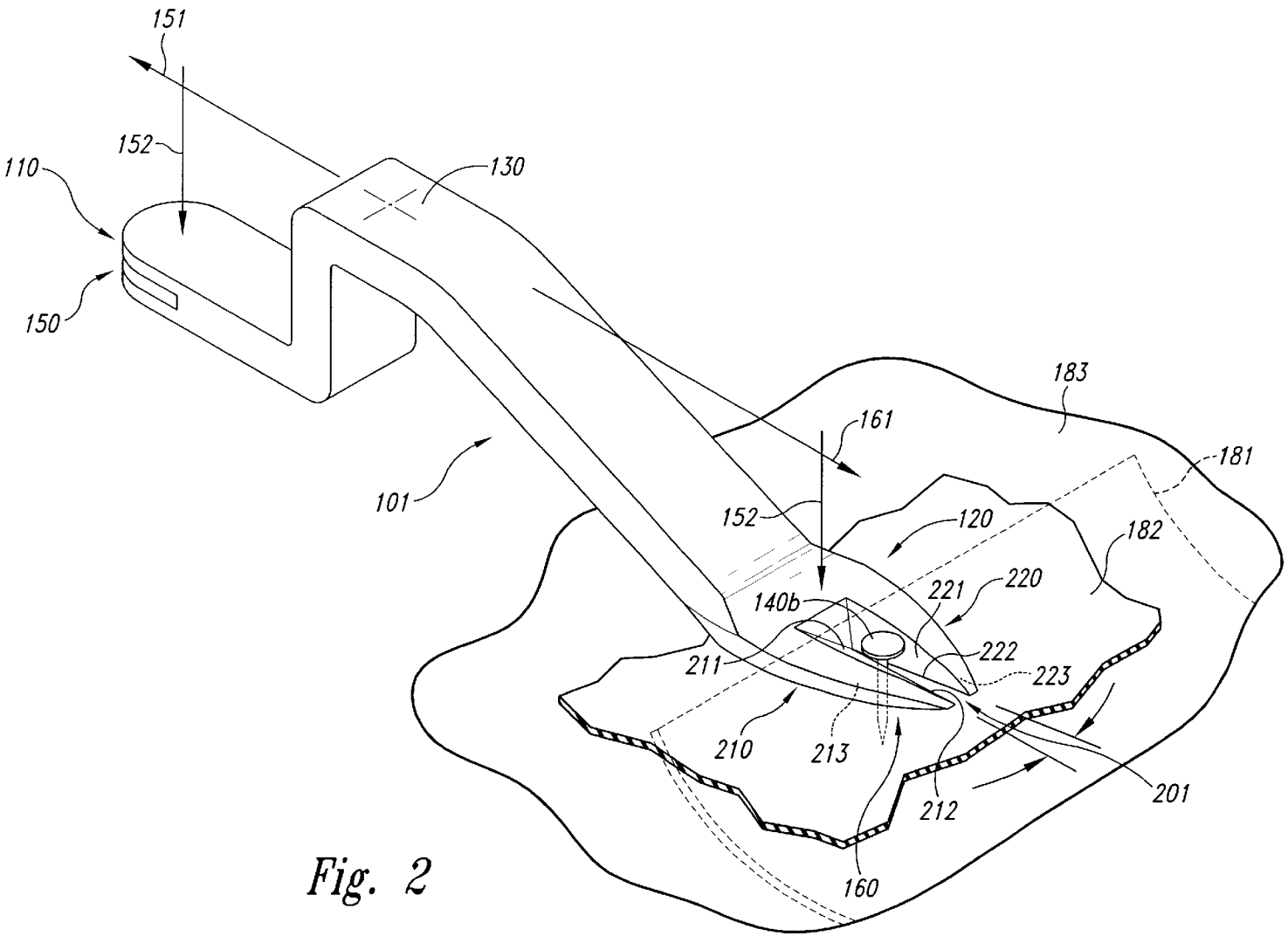
FIG. 2 is an enlarged rear isometric view of the fastener installation and removal tool shown in FIG. 1 positioned to remove a fastener from a damaged shingle that is located underneath an installed shingle.

FIG. 2 is an enlarged rear isometric view of the tool 101 with the fastener removal portion 120 positioned to remove an installed fastener 140*b* from a workpiece such as a damaged shingle 182. In one embodiment, the fastener removal portion 120 has a first finger 210 and a second finger 220 that both extend generally away from the impact surface 130 in the third direction 161. The first finger 210 has a downwardly facing first heel surface 213 and a first interior surface 211 that are connected by a first interior edge 212. The second finger 220 has a downwardly facing second heel surface 223 and a second interior surface 221 connected by a second interior edge 222. As shown in FIG. 2, the first and second interior edges 212 and 222 define a tapering gap 201. In one embodiment, the gap 201 tapers by an angle of from about 10 to about 30 degrees, and in another embodiment, the taper angle is about 14.25 degrees. In other embodiments, the gap 201 can taper by angles having other values.

In one embodiment, the gap 201 of the tool 101 is configured to releasably engage the installed fastener 140*b* and extract the fastener 140*b* from a damaged shingle 182 mounted to the roof substructure 183. In one aspect of this embodiment, the fastener removal portion 120 of the tool 101 has a relatively low profile that projects by only a limited amount above the damaged shingle 182. Accordingly, the installed fastener 140*b* can be removed by inserting the fastener removal portion 120 beneath the installed shingle 181 without bending the installed shingle 181 to the point of breaking. In another aspect of this embodiment, the user can produce an upward force on the head of the fastener 140*b* by applying a downward force to the impact surface 130 or the fastener engagement portion 110 of the tool 101 while the fingers 210 and 220 are engaged with the head of the fastener 140*b* to pivot the tool 101 about the first and second heel surfaces 213 and 223. This upward force extracts the fastener 140*b* from the damaged shingle 182 and the roof substructure 183. Alternatively, other tools may be used to extract the fastener 140*b* from the damaged shingle 182. In either embodiment, the damaged shingle 182 can then be removed and the replacement shingle 180 can be installed without breaking the previously installed shingle 181 by using the fastener engagement portion 110.

Figure 3:
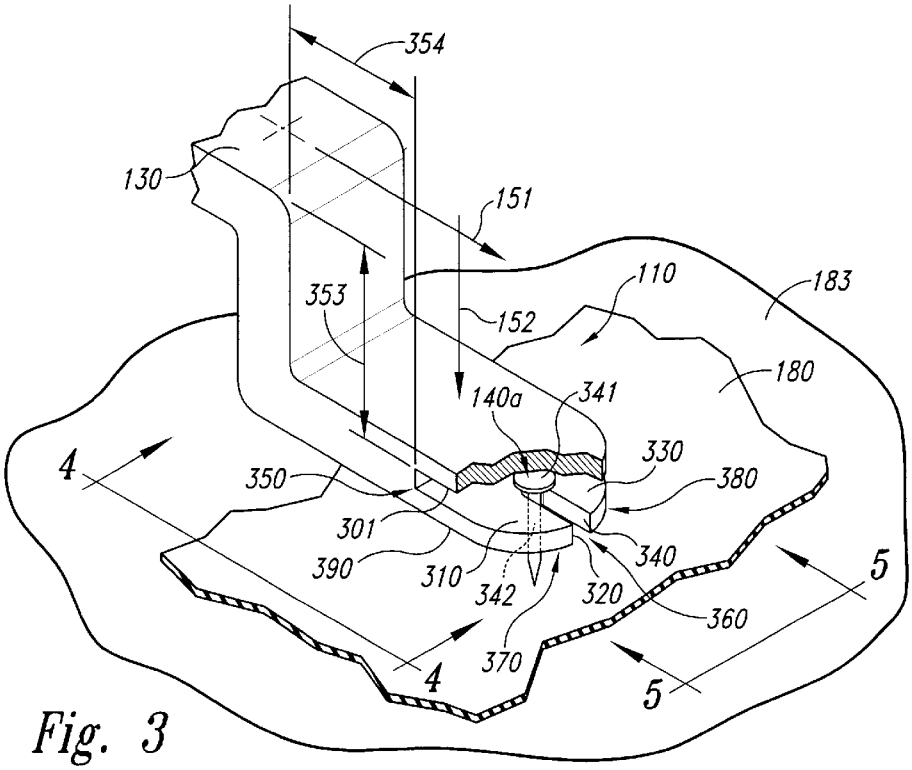
FIG. 3 is an enlarged front isometric view of a fastener engagement portion of the tool and fastener shown in FIG. 1.
Figure 4:
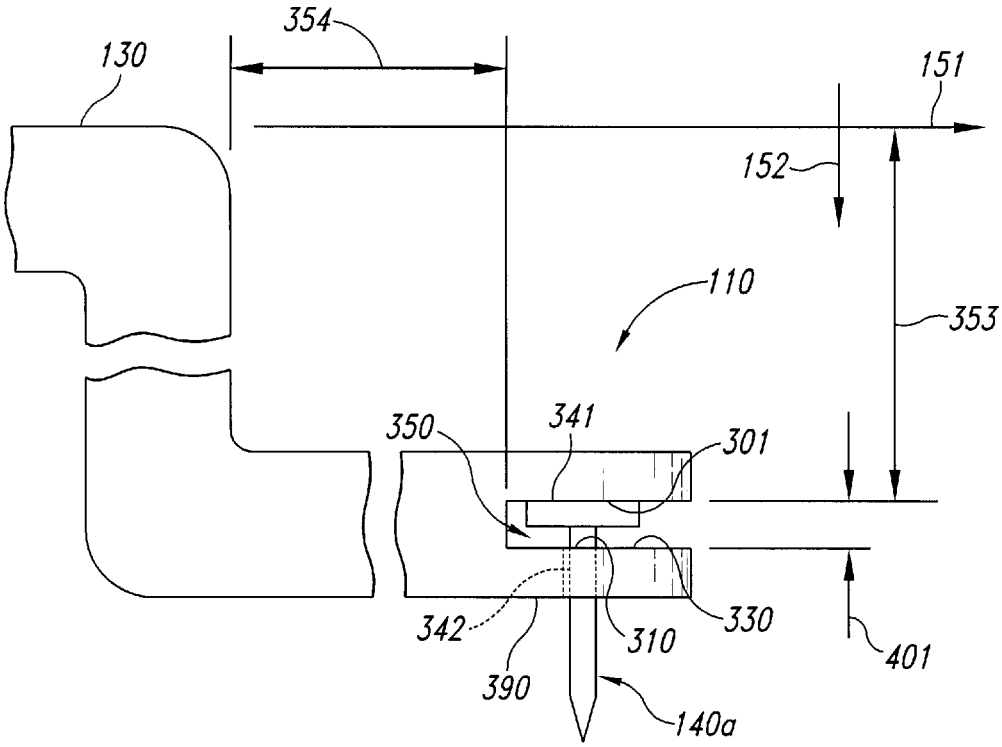
FIG. 4 is an enlarged side elevation view of the fastener engagement portion of the tool and fastener shown in FIG. 1.
Figure 5:
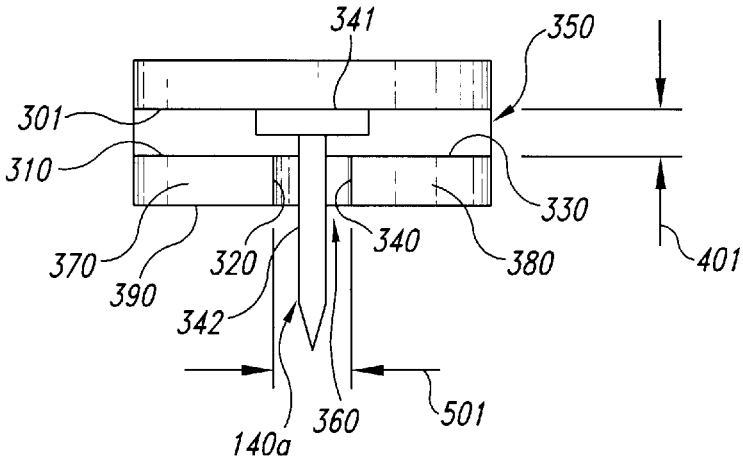
FIG. 5 is an enlarged front elevation view of the fastener engagement portion of the tool and fastener shown in FIG. 1.

FIG. 3 is a front isometric view of the fastener engagement portion 110 of the tool 101 and the fastener 140*a*, positioned above the replacement shingle 180. FIG. 4 is a side elevation view and FIG. 5 is a front elevation view of the fastener engagement portion 110 and the fastener 140*a* shown in FIG. 3. Referring to FIGS. 3, 4, and 5, the fastener engagement portion 110 has a first fastener contact surface 301 and a second fastener contact surface 390 that are offset from and at least approximately parallel to the impact surface 130. The first fastener contact surface 301 can be offset from the impact surface 130 by a first distance 354 in the first direction 151, and by a second distance 353 in the second direction 152 (FIGS. 3 and 4). In one embodiment, the first distance 354 can be between 0.5 and 5.0 inches, and the second distance 353 can be between 0.5 and 3.0 inches. In another embodiment, the second distance 353 can be about 1.64 inches. In other embodiments, the distances 353 and 354 can have other values that allow the tool to be operated in the manner described below.

The fastener engagement portion 110 also has a first fastener guide member 370 and a second fastener guide member 380 (FIGS. 3 and 5). The first fastener guide member 370 has a first fastener guide surface 310 and a first fastener alignment surface 320. The second fastener guide member 380 has a second fastener guide surface 330 and second fastener alignment surface 340. The first and second guide surfaces 310 and 330 are in a common plane and are spaced apart from the fastener contact surface 301 by a first gap distance 401 (FIGS. 4 and 5) to define a head slot 350 sized to accommodate a head 341 of the fastener 140*a*. In one embodiment, the gap distance 401 can be about 0.10 inches, and in other embodiments, the distance can have other values that accommodate the head 341. The first and second fastener alignment surfaces 320 and 340 oppose each other and are spaced apart by a second gap distance 501 (FIG. 5) to define a shank slot 360 sized to accommodate a shank 342 of the fastener 140*a*. In one embodiment, the second gap distance 501 can be about 0.184 inches, and in other embodiments, the distance can have other values that accommodate the shank 342. Accordingly, the head slot 350 is offset from and generally parallel with the impact surface 130. The shank slot 360 intersects the head slot 350 and is transverse to the impact surface 130.

Referring now to FIG. 3, the fastener engagement portion 110 of the tool 101 is configured to releasably engage the fastener 140*a* so that it may be driven into the replacement shingle 180 when the impact surface 130 is struck with a conventional hammer or a similar tool. In one embodiment, the fastener 140*a* is engaged with the fastener engagement portion 110 by removably positioning the shank 342 of the fastener 140*a* between the first fastener alignment surface 320 and the second fastener alignment surface 340, and by removably positioning the head 341 of the fastener 140*a* between the fastener contact surface 301 and the first and second guide surfaces 310 and 330. In an alternate embodiment, the surfaces 301 or 390 may also be magnetized to releasably engage the fastener 140*a* prior to installation. In either embodiment, when the user strikes the impact surface 130 with a conventional hammer or a similar tool, the fastener contact surface 301 drives the fastener into the replacement shingle 180. After the user drives the fastener 140*a* part-way into the replacement shingle 180 (or completely through the replacement shingle 180 and part-way into the roof substructure 183), the user retracts the fastener engagement portion 110 to disengage it from the fastener 140*a*, and then repositions the fastener engagement portion 110 so that the second fastener contact surface 390 is in contact with the head 341 of the fastener 140*a*. The user then strikes the impact surface 130 with the hammer to drive the fastener 140*a* the rest of the way into the roof substructure 183, so that the head 341 of the fastener 140*a* is now flush with the upper surface of the replacement shingle 180.

In one embodiment of the invention, the user can operate the fastener installation and removal tool 101 to replace a damaged asphalt roofing shingle without damaging the previously installed overlapping shingle 181 in the process. For example, the user can remove the fastener 140*b* attaching the damaged shingle 182 to the roof substructure 183 by using the fastener removal portion 120 of the tool 101 (FIG. 2). The user can then slide the replacement shingle 180 into position underneath the overlapping shingle 181, and releasably engage the fastener engagement portion 110 of the tool 101 with the new fastener 140*a* (FIG. 3). In one aspect of this embodiment, the fastener engagement portion 110 is offset from the impact surface 130, and has a relatively low profile that projects only a limited amount above the replacement shingle 180. Accordingly, the overlapping shingle 181 need only be lifted a lifting distance that is slightly more than the height of the fastener 140*a* to create an opening where the fastener engagement portion 110 can be slipped underneath the overlapping shingle 181 to position the new fastener 140*a* in the appropriate location on the replacement shingle 180 (FIG. 1). A conventional hammer 184 may then be used to strike the impact surface 130 of the tool 101. When used in the manner described above, the tool 101 allows the replacement shingle 180 to be installed underneath the overlapping shingle 181 without lifting the overlapping shingle 181 so much that it breaks.

In other embodiments, the tool 101 can be used for other applications where access is limited. For example, the tool 101 can be used to install fasteners into a floor covering under an overhanging stair step, where the presence of the step creates a limited opening that makes the use of a conventional hammer alone impractical or awkward. In yet other embodiments, the tool 101 can have other configurations for fastener installation and other applications, as described below with reference to FIGS. 6A–9.

Figure 6A:
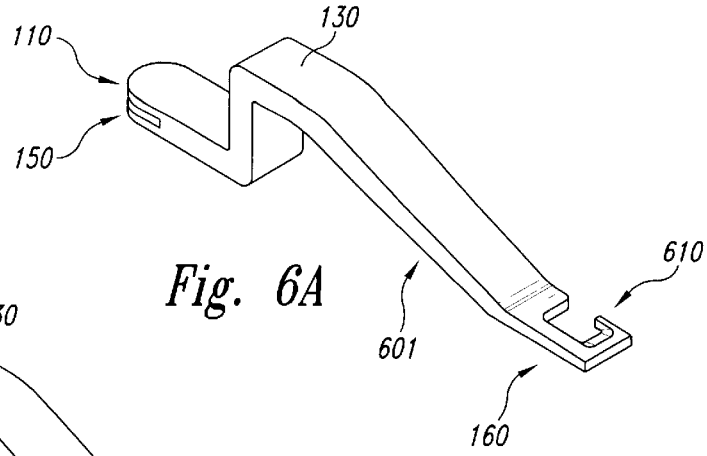
FIGS. 6A, 6B, 6C and 6D are isometric views of fastener installation tools having tool devices in accordance with other embodiments of the invention.
Figure 6B:
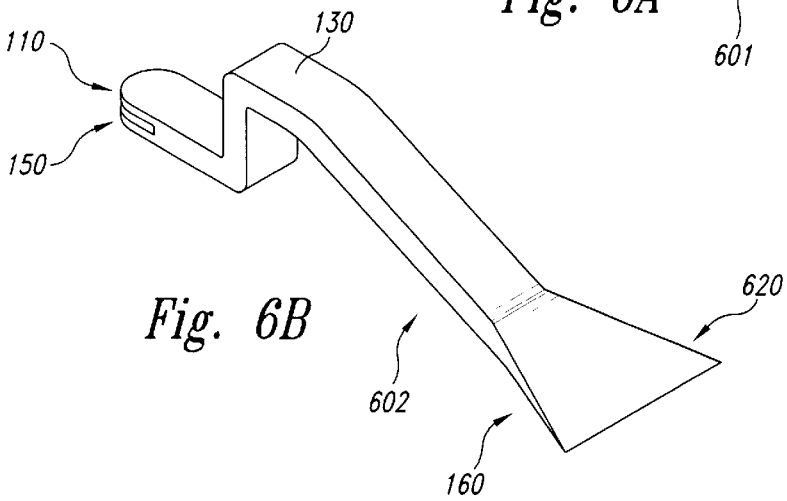
Figure 6C:
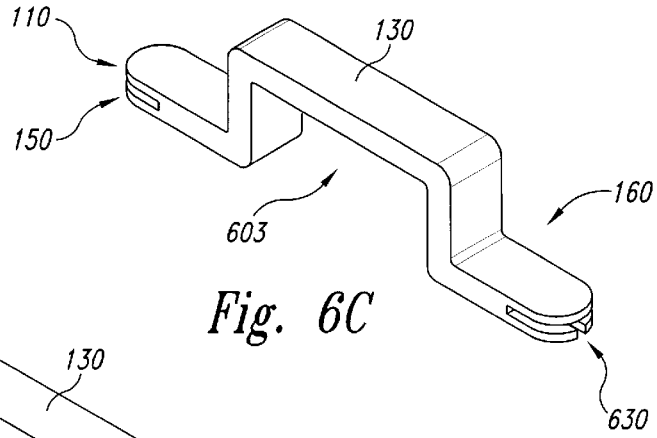
Figure 6D:
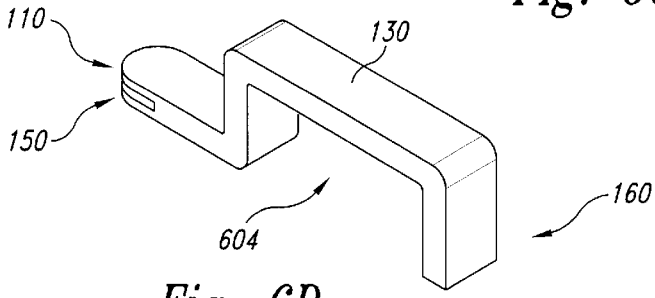

FIGS. 6A, 6B, 6C, and 6D illustrate tools having second ends with other configurations in accordance with alternate embodiments of the invention. FIG. 6A is an isometric view of a tool 601 having a G-shaped pry-hook device 610 located toward the second end 160 for removing and/or loosening fasteners, or prying other objects. FIG. 6B is an isometric view of a tool 602 having a shingle remover or scraper 620 toward the second end 160 in accordance with another embodiment of the invention. FIG. 6C is an isometric view of a tool 603 wherein the fastener engagement portion 110 toward the first end 150 is a first fastener engagement portion, and the tool has a second fastener engagement portion 630 toward the second end 160 in accordance with yet another embodiment of the invention. FIG. 6D is an isometric view of a tool 604 in which the second end 160 simply supports the impact surface 130 in an offset position in accordance with still another embodiment of the invention. In other embodiments, the tool can have a second end with other configurations that can complement the function provided by the fastener engagement portion 110.

Figure 7:
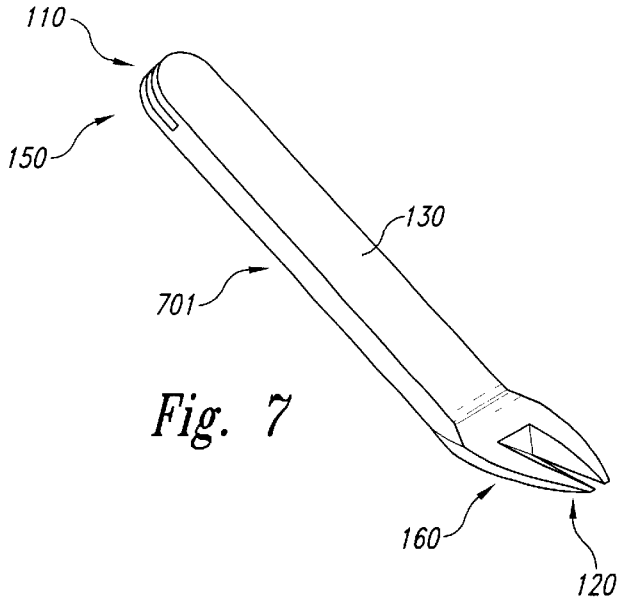
FIG. 7 is an isometric view of a fastener installation and removal tool having a non-offset impact surface in accordance with another embodiment of the invention.

FIG. 7 is an isometric view of a tool 701 having the fastener engagement portion 110 and the fastener removal portion 120 generally aligned with the impact surface 130 in accordance with another embodiment of the invention. Accordingly, the tool 701 can be easily stored when not in use. Conversely, an advantage of the tool 101 described above with reference to FIG. 1 is that the offset configuration can provide a more convenient impact surface for a hammer or a similar tool.

Figure 8:
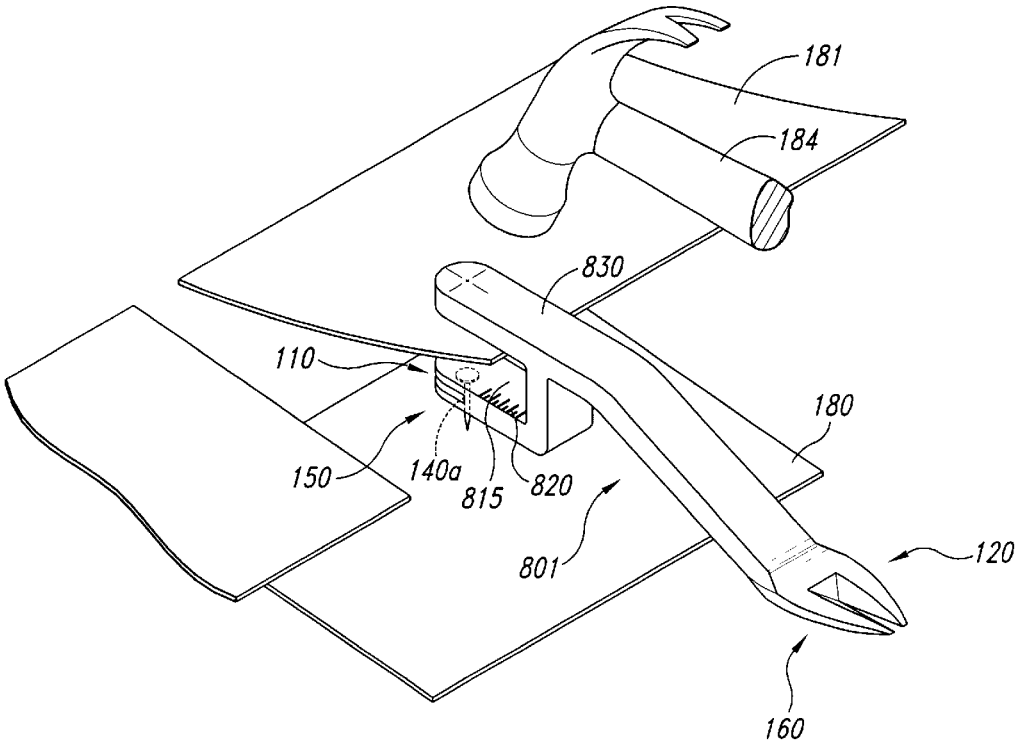
FIG. 8 is an isometric view of a fastener installation and removal tool positioned to install a fastener in a replacement roofing shingle that is located underneath an installed shingle in accordance with yet another embodiment of the invention.

FIG. 8 is a rear isometric view of a tool 801 having an impact surface 830 that extends over the fastener engagement portion 110. Accordingly, the impact surface 830 can provide a more direct line of action between the fastener 140*a* and the point at which the hammer impacts the tool 801. An advantage of this feature is that the tool 801 can be easier to hold during use. In another aspect of this embodiment, an upper surface 815 of the fastener engagement portion 110 can include graduation marks 820 to provide a guide for positioning the fastener 140*a* under the overlapping shingle 181.

Figure 9:
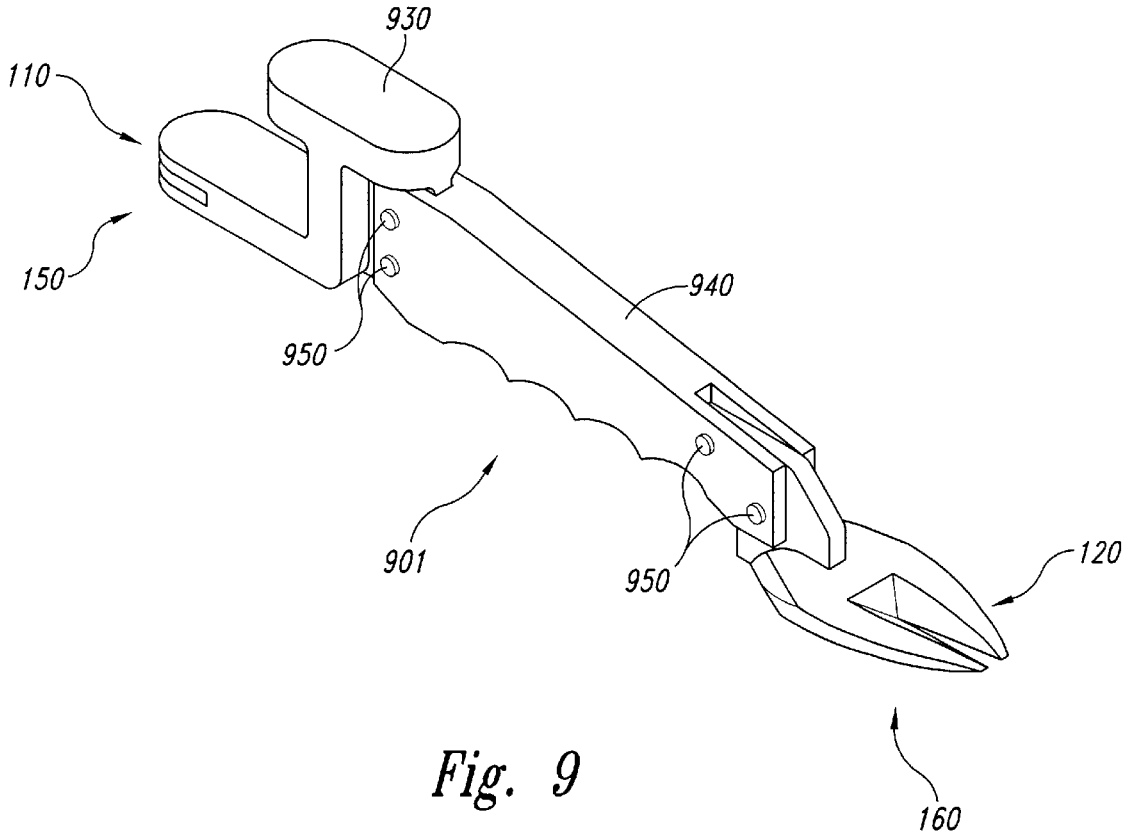
FIG. 9 is an isometric view of a fastener installation and removal tool having coupled portions in accordance with still another embodiment of the invention.

FIG. 9 is a rear isometric view of a tool 901 that includes three joined parts in accordance with another embodiment of the invention. The tool 901 can include a fastener engagement portion 110 and a fastener removal portion 120 rigidly joined to a handle member 940 with permanent fasteners 950. Alternatively, the tool 901 can include pivot pins instead of the permanent fasteners 950 so that the fastener engagement portion 110 and the fastener removal portion 120 can fold over the handle portion 940 for easy storage of the tool.

From the foregoing it will be appreciated that although specific embodiments of the invention may be described herein for purposes of illustration, various modifications may be made without deviating from the spirit and scope of the invention. The teachings provided herein of the present invention may be applied to fastener installation and removal tools in general, and not only to the exemplary roofing tool described above. Accordingly, the invention is not limited by this disclosure, but instead the scope is to be determined entirely by the following claims.

What is claimed is:

1. A fastener handling device, comprising:

a body having a first end, a second end, and an impact surface between the first and second ends, the body having a fastener engagement portion toward the first end extending away from the impact surface in a first direction and being offset from the impact surface in a second direction transverse to the first direction, the fastener engagement portion having at least one fastener contact surface that is offset from and at least approximately parallel to the impact surface, the fastener engagement portion being configured to releasably engage a fastener to install the fastener in a workpiece when a force is applied to the impact surface of the body.

2. The device of claim 1 wherein the body includes a fastener removal portion toward the second end, the fastener removal portion being offset from the impact surface in the second direction and extending away from the impact surface in a third direction transverse to the second direction to releasably engage and remove an installed fastener.

3. The device of claim 1 wherein the fastener engagement portion includes first and second fastener guide surfaces, the first and second guide surfaces being in a common plane and being spaced apart from the fastener contact surface by a first gap distance and being spaced apart from each other by a second gap distance, the first gap distance sized to removably receive a head of the fastener, the second head gap distance sized to removably receive a shank of the fastener.

4. The device of claim 1 wherein the fastener engagement portion includes first and second fastener guide surfaces, the first and second guide surfaces being in a common plane and being spaced apart from the fastener contact surface by a first gap distance of 0.10 inches and being spaced apart from each other by a second gap distance of 0.184 inches.

5. The device of claim 1 wherein the fastener engagement portion includes a first slot with a first width, the first slot being offset from and aligned with the impact surface, and a second slot with a second width, the second slot intersecting the first slot and being transverse to the impact surface.

6. The device of claim 1 wherein the fastener contact surface of the fastener engagement portion is offset from the impact surface by 1.64 inches in the second direction.

7. The device of claim 1 wherein the body is integrally formed from a single piece of material.

8. A fastener installation and removal device, comprising:

a body having a first end, a second end, and an impact surface between the first and second ends, the body having a fastener engagement portion toward the first end extending away from the impact surface in a first direction and being offset from the impact surface in a second direction transverse to the first direction, the fastener engagement portion having a fastener contact surface that is offset from and at least approximately parallel to the impact surface, the fastener engagement portion being configured to releasably engage a fastener to install the fastener into a first workpiece when a first force is applied to the impact surface of the body, the body having a fastener removal portion toward the second end being offset from the impact surface in the second direction and extending away from the impact surface in a third direction transverse to the second direction, the fastener removal portion being configured to releasably engage an installed fastener to remove the installed fastener from a second workpiece when a second force is applied to the body.

9. The device of claim 8 wherein the fastener removal portion includes:

a first finger extending away from the impact surface and having a first heel surface, a first interior surface, and a first interior edge between the first heel surface and the first interior surface; and a second finger extending away from the impact surface and having a second heel surface, a second interior surface, and a second interior edge between the second heel surface and the second interior surface, the first and second interior edges defining a tapering gap.

10. The device of claim 8 wherein the fastener removal portion includes:

a first finger extending away from the impact surface and having a first heel surface, a first interior surface, and a first interior edge between the first heel surface and the first interior surface; and a second finger extending away from the impact surface and having a second heel surface, a second interior surface, and a second interior edge between the second heel surface and the second interior surface, the first and second interior edges defining a tapering gap having a gap angle of from about 10 degrees to about 30 degrees.

11. The device of claim 8 wherein the fastener contact surface of the fastener engagement portion is offset from the impact surface by a distance of between 0.50 and 5.0 inches in the first direction, and by between 0.50 and 3.0 inches in the second direction transverse to the first direction.

12. The device of claim 8 wherein the body includes a metallic material.

13. The device of claim 8 wherein the body is integrally formed from a single piece of material.

14. The device of claim 8 wherein the fastener contact surface of the fastener engagement portion includes a magnetic material.

15. A fastener installation and removal device, comprising:

a body having a first end, a second end, and a tool-impact surface between the first and second ends, the body having a fastener engagement portion toward the first end extending away from the tool-impact surface in a first direction, the fastener engagement portion having a fastener contact surface that is at least approximately parallel to the tool-impact surface, the fastener engagement portion being configured to releasably engage a fastener to install the fastener into a first workpiece when a first force is applied to the impact surface of the body, the body having a fastener removal portion toward the second end and extending away from the impact surface in a third direction, the fastener removal portion being configured to releasably engage an installed fastener to remove the installed fastener from a second workpiece when a second force is applied to the body.

16. The device of claim 15 wherein the body is formed from a single piece of material.

17. The device of claim 15 wherein the fastener engagement portion includes first and second fastener guide surfaces, the first and second guide surfaces being in a common plane and being spaced apart from the fastener contact surface by a first gap distance of 0.10 inches and being spaced apart from each other by a second gap distance of 0.184 inches.

18. The device of claim 15 wherein the fastener removal portion includes:

a first finger extending away from the impact surface and having a first heel surface, a first interior surface, and a first interior edge between the first heel surface and the first interior surface; and a second finger extending away from the impact surface and having a second heel surface, a second interior surface, and a second interior edge between the second heel surface and the second interior surface, the first and second interior edges defining a tapering gap having a gap angle of from about 10 degrees to about 30 degrees.

19. A fastener installation and removal device, comprising:

a body having a first end, a second end, and an impact surface between the first and second ends, the body having a fastener engagement portion toward the first end, the fastener engagement portion extending away from the impact surface in a first direction and being offset from the impact surface in a second direction transverse to the first direction, the fastener engagement portion having a fastener contact surface that is offset from and at least approximately parallel to the impact surface, the fastener engagement portion also having first and second guide surfaces opposing the fastener contact surface, the first and second guide surfaces being in a common plane and being spaced apart from the fastener contact surface by a first gap distance and being spaced apart from each other by a second gap distance, the fastener engagement portion being configured to releasably engage a fastener and install the fastener into a workpiece when a force is applied to the impact surface of the body, the body having a tool portion toward the second end extending away from the impact surface of the body.

20. The device of claim 19 wherein the tool portion of the body includes a scraper portion for removing shingles.

21. The device of claim 19 wherein the fastener engagement portion is a first fastener engagement portion and the tool portion of the body includes a second fastener engagement portion.

22. The device of claim 19 wherein the tool portion of the body includes a G-shaped pry-hook portion.

23. A nail installation and removal tool for use in the repair of overlapping roofing shingles, comprising:

a body having a fastener engagement portion toward a first end, a fastener removal portion toward a second end, and an impact surface between the fastener engagement portion and the fastener removal portion, wherein the fastener engagement portion extends away from the impact surface in a first direction and is offset from the impact surface in a second direction transverse to the first direction, the fastener engagement portion having a fastener contact surface that is offset from and at least approximately parallel to the impact surface, the fastener engagement portion further having first and second fastener guide members, the first fastener guide member having a first guide surface and a first alignment surface, the second fastener guide member having a second guide surface and a second alignment surface, the first and second guide surfaces being in a common plane and being spaced apart from the fastener contact surface by a first gap distance, the first and second alignment surfaces facing each other and being spaced apart from each other by a second gap distance, further wherein the fastener removal portion is offset from the impact surface in the second direction and extends away from the impact surface in a third direction transverse to the second direction, the fastener removal portion having a first finger and a second finger that extend away from the impact surface, the first finger having a first heel surface and a first interior surface that are connected by a first interior edge, the second finger having a second heel surface and a second interior surface that are connected by a second interior edge, the first and second interior edges of the first and second fingers defining a tapering gap.

24. The tool of claim 23 wherein the first and second guide surfaces are spaced apart from the fastener contact surface by a first gap distance of 0.10 inches.

25. The tool of claim 23 wherein the first and second alignment surfaces are spaced apart from each other by a second gap distance of 0.184 inches.

26. The tool of claim 23 wherein the first and second interior edges define a tapering gap having a gap angle of about 14.25 degrees.

27. A method for repairing a shingled roof, comprising:

removing a damaged roofing shingle from the roof;

positioning a replacement roofing shingle in place of the damaged shingle underneath a previously installed overlapping shingle;

engaging a fastener with a fastener installation tool having a fastener engagement portion extending away from an impact surface of the tool in a first direction and being offset from the impact surface by an offset distance in a second direction transverse to the first direction;

lifting an edge of the overlapping shingle by a lifting distance less than the offset distance and aligned with the second direction;

inserting the fastener engagement portion under the lifted shingle and positioning the engaged fastener on the replacement shingle so that the impact surface of the fastener installation tool is exposed;

impacting the impact surface of the fastener installation tool to drive the fastener into the replacement shingle;

disengaging the fastener engagement portion of the fastener installation tool from the fastener;

repositioning the fastener engagement portion so that an underside of the fastener engagement portion contacts a head of the fastener;

impacting the exposed impact surface of the fastener installation tool to further drive the fastener into the replacement shingle; and withdrawing the fastener installation tool from under the overlapping shingle.

28. The method of claim 27 wherein engaging a fastener with a fastener installation tool includes removably positioning the head of the fastener in a slot that is offset from and at least approximately parallel to the impact surface.

29. The method of claim 28 wherein the slot is a first slot, and engaging a fastener with a fastener installation tool further includes removably positioning a shank of the fastener in a second slot that intersects and is transverse to the first slot.

30. The method of claim 27 wherein the lifting distance is a first lifting distance and removing the damaged roofing shingle includes:

lifting the edge of the overlapping shingle by a second lifting distance less than the offset distance and aligned with the second direction;

inserting a fastener removal portion of the fastener installation and removal tool under the lifted shingle, the fastener removal portion being offset from the impact surface in the second direction;

engaging an installed fastener with the fastener removal portion; and applying a force to the tool to remove the installed fastener from the damaged shingle.

31. A method for installing a fastener in a workpiece in a confined work-space, comprising:

engaging the fastener with a fastener installation tool having a fastener contact surface extending away from an impact surface of the tool by a first distance in a first direction and being offset from the impact surface by a second distance in a second direction transverse to the first direction;

inserting the fastener contact surface through an opening defined by a third distance in a third direction that is aligned with the second direction, the third distance being less than the second distance;

positioning the engaged fastener on the workpiece so that the impact surface is exposed;

impacting the exposed impact surface of the fastener installation tool to drive the fastener into the workpiece; and disengaging the fastener installation tool from the fastener.

32. The method of claim 31 wherein the fastener contact surface is a first fastener contact surface, further comprising:

repositioning the fastener installation tool so that a head of the fastener contacts a second fastener contact surface of the fastener installation tool that is offset from the first fastener contact surface;

impacting the exposed impact surface of the fastener installation tool to further drive the fastener into the workpiece; and withdrawing the fastener installation tool from the opening.

33. The method of claim 31 wherein impacting the exposed impact surface of the tool to drive the fastener into the workpiece includes driving the fastener into the workpiece until the head is flush with a top surface of the workpiece.

34. The method of claim 31 wherein engaging a fastener with a fastener installation tool includes orienting the fastener so that a head of the fastener aligns with a first gap between the fastener contact surface and a fastener guide surface, and a shank of the fastener aligns with a second gap between first and second fastener alignment surfaces.

* * * * *